United States Patent [19]

Chasen

[11] 4,095,768

[45] Jun. 20, 1978

[54] BRACKET ASSEMBLY

[75] Inventor: Lee Richard Chasen, Port Chester, N.Y.

[73] Assignee: Coats & Clark, Inc., Stamford, Conn.

[21] Appl. No.: 652,299

[22] Filed: Jan. 26, 1976

[51] Int. Cl.[2] ..... A47F 5/00

[52] U.S. Cl. ..... 248/290; 248/304

[58] Field of Search ..... 248/289 R, 289 A, 290, 248/294, 296, 304

[56] References Cited

U.S. PATENT DOCUMENTS

| | | | |
|---|---|---|---|
| 453,036 | 5/1891 | Brady | 248/207 |
| 1,133,429 | 3/1915 | Christensen | 248/296 |
| 1,505,567 | 8/1924 | Kelley | 248/289 |
| 1,518,824 | 12/1924 | Smith | 248/290 |
| 1,525,533 | 2/1925 | Brown | 248/290 |
| 1,930,606 | 10/1933 | Bousfield | 248/289 |
| 2,294,998 | 9/1942 | Mitchell | 248/201 |
| 3,045,832 | 7/1962 | Hibbard | 248/304 |

FOREIGN PATENT DOCUMENTS

| | | | |
|---|---|---|---|
| 457,606 | 6/1949 | Canada | 248/289 |

*Primary Examiner*—Robert A. Hafer

*Attorney, Agent, or Firm*—Burgess, Ryan and Wayne

[57] ABSTRACT

A bracket assembly has a rod with a hook, which may be a swivel hook, affixed to one end. A wall bracket is held on the other end of the rod, for maintaining any of a plurality of given angular displacements, in a horizontal plane, between the rod and a wall. The hook end of the rod is supported by a chain, cord or the like extending from a fitting on the wall above the wall bracket to a support point on the rod further from the wall than the hook. The wall bracket may have a pivot joint with a plurality of fixed pivot positions changeable only by lifting the rod, or it may be comprised of a block having a plurality of horizontal holes at determined angular displacements.

11 Claims, 9 Drawing Figures

13
16
71
74
78
77
76
72
79
73
75
77
10
70

71
77
78
79
10
13
70
73
77

15
13

II
II
14
32
12
31
30
44
38
20
26
22
21
II
25
24
16
15
15
23
22
24

13
10
10
10
26
21
22
10
10

BRACKET ASSEMBLY

This invention relates to brackets, and is more particularly directed to a bracket for suspending an article from a wall, at a point spaced outwardly from the wall.

It is frequently desirable to suspend an article, such as a flower pot, at a position spaced from a wall. A number of different styles of wall brackets are available for this purpose. Many of such brackets do not have a sufficiently pleasing appearance, however, to permit their use in a home. This is particularly true as the size of the bracket is increased, in order to suspend an article such as a plant at a further distance from a wall. In addition, such brackets are usually designed to suspend an article only at one position, so that there is no possibility of adjustment in the position of the article.

The present invention is directed to the provision of a wall bracket having the features that, by a simple and economical means, an article may be suspended at any of a number of fixed positions with respect to a wall, the bracket being capable of being provided with a pleasing appearance, and being suitable for use in a home.

Briefly stated, in accordance with the invention, a bracket assembly includes an elongated support member, such as a rod or spindle, having a hook adjacent one end for suspending an article. A wall bracket fitting is provided at the other end of the rod, for supporting the rod at any of a number of fixed angular positions, in a horizontal plane, with respect to the wall. In addition, a support means, such as a chain or rope, is provided for extending between the wall, at a point above the wall bracket, and a point along the rod further from the bracket than the hook. A suitable hook or strap is provided to hold the chain or cord to the wall.

In one form, the wall bracket comprises a base member having a fixed projection extending therefrom, the projection having a vertical non-circular aperture extending therethrough. The aperture may, for example, by polygonal. The wall bracket further includes a bifurcated fitting adapted to be held on the end of the rod, with a pin of non-circular cross section extending vertically between the bifurcated ends of the fitting and through the aperture. The pin has the same cross section as the aperture at its upper end, but tapers inwardly in the downward direction, whereby when the fitting is in its lowermost position, it is restrained from angular displacement, but the fitting and the rod may be rotated with respect to the wall in the upper position of the element. Since the hook is located inwardly of the lower end of the chain or cord, a load on the hook urges the fitting to its lowermost position, to maintain the angular displacement of the rod.

The wall bracket may alternatively comprise a block having horizontal holes therein adapted to receive the rod and hold it at determined angular positions.

The hook may advantageously be in the form of a swivel hook.

In order that the invention will be more clearly understood, it will now be disclosed in greater detail with reference to the accompanying drawings, wherein.

Figures 1, 2, 3, 8, 9:
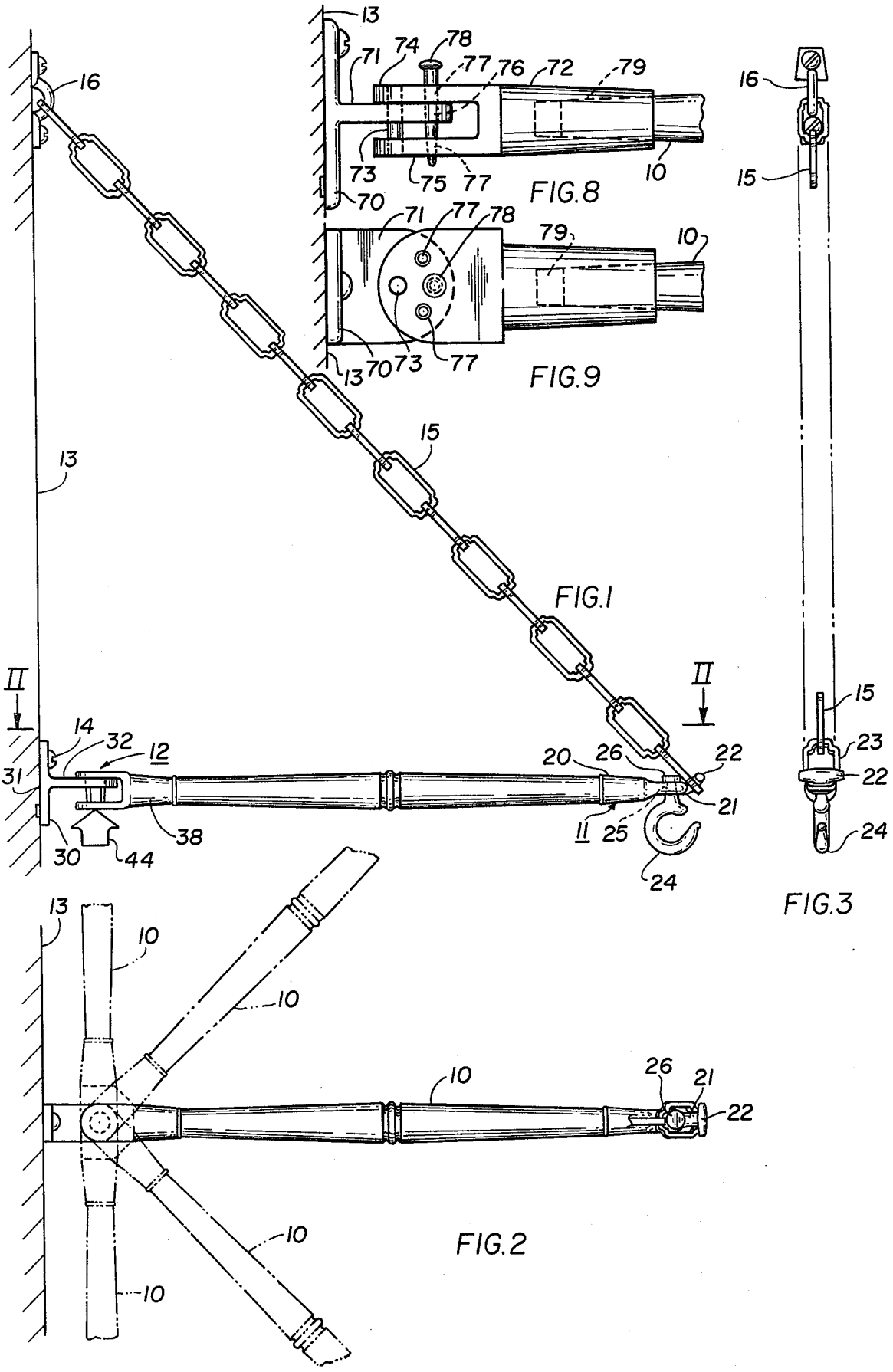
FIG. 1 is a side view of a bracket assembly in accordance with one embodiment of the invention.
FIG. 2 is a partially cross sectional top view of the bracket assembly of FIG. 1, taken along the lines II—II of FIG. 1, and illustrating various positions of the assembly.
FIG. 3 is a front view of the bracket assembly of FIG. 1.
FIG. 8 is a die view of a further modification of the bracket of FIG. 1.
FIG. 9 is a top view of the bracket of FIG. 8.

Referring now to the drawings, and more in particular to FIGS. 1–3, the bracket assembly is comprised of a rod or spindle 10 having a hook fitting 11 on one end and a wall mounting bracket 12 on the other end. The wall mounting bracket 12 is affixed to a wall 13 by conventional means, such as a screw 14.

An end support means, such as a chain 15, a cord or the like, extends between a strap 16 affixed to the wall above the wall mounting bracket 12, and the hook fitting 11.

In the illustrated embodiment of the invention, the hook fitting comprises a base portion 20 having a hole extending into one end for receiving the end of the rod or spindle 10. The end of the base member 20 away from the rod 10 is formed in a suitable manner to be held by the chain 15. For example, a portion 21 of the base member 20 adjacent the remote end thereof may have a reduced cross section, with a horizontal bar shaped end 22 on the end of the portion 21, thereby forming a T-shaped end on the base member 20. As illustrated, the end link 23 of the chain may thus be fitted over the T-shaped end of the member 20. It will of course be apparent that other shapes may be provided for the end of the base member 20.

A hook, such as swivel hook 24, is provided extending downwardly from the base member 20. This hook may be of the type disclosed in co-pending application Ser. No. 549,313, filed Feb. 12, 1975. Briefly, the hook 24 has a tapered shank 25 extending through a vertical tapered aperture in the base 20, and an enlarged end 26 on the upper end of the shank for holding the hook on the base member. The tapered shape of the shank, which has a smaller cross section at its upper end, enables the hook to be made with a free swivel joint, when formed by the process disclosed in said application Ser. No. 549,313.

Since the hook 24 is pivotally mounted to the base 20 inwardly of the T-shaped end of the member 20, it will be apparent that any load on the hook will result in a downward moment at the end of the rod or spindle 10 toward the wall. The importance of this feature will be discussed in the following paragraphs.

Figure 5:
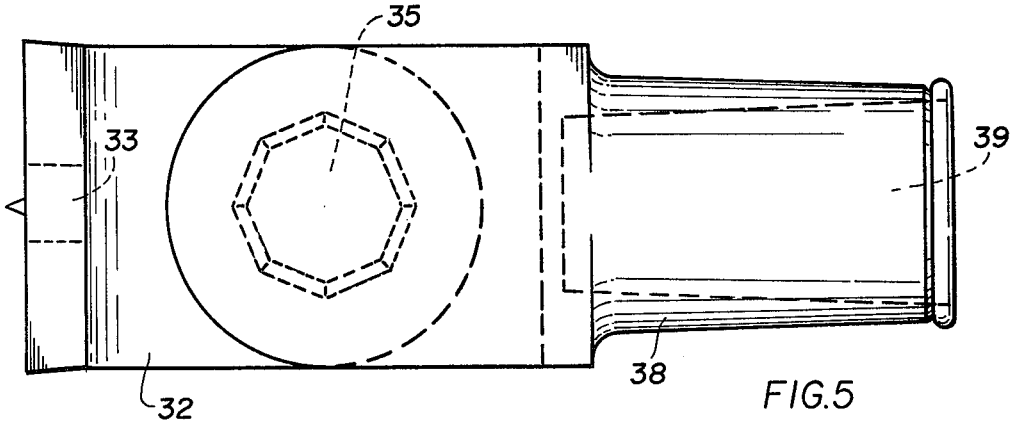
FIG. 5 is a top view of the pivot assembly of FIG. 4.
Figure 4:
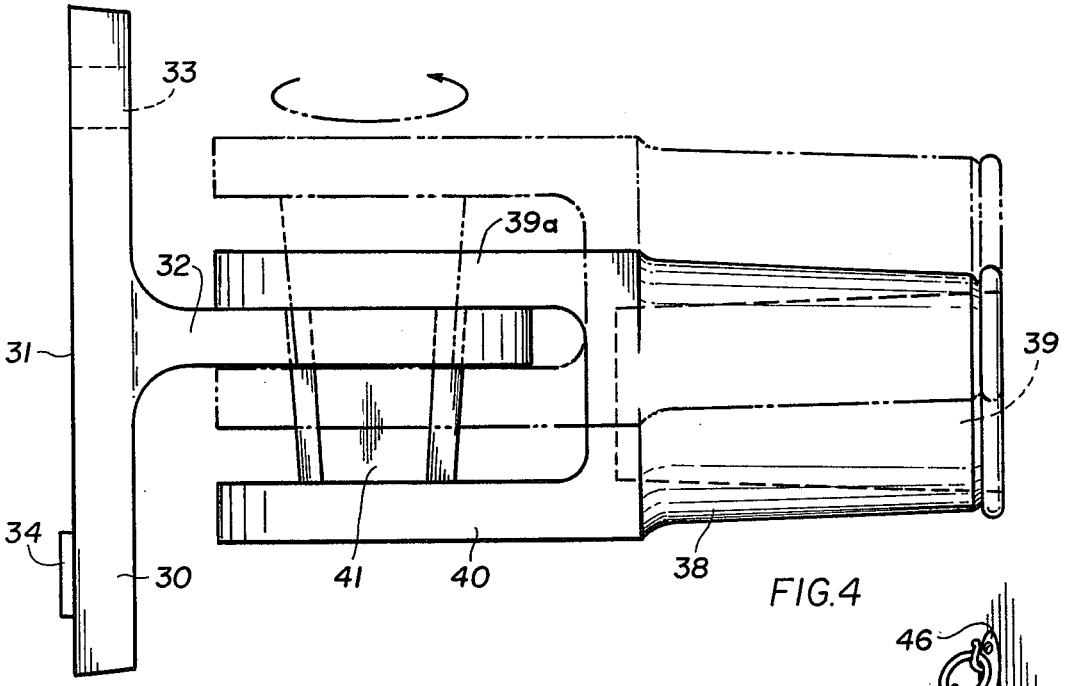
FIG. 4 is an enlarged side view of the pivot assembly of the bracket assembly of FIG. 1.

The wall mounting bracket 12 of FIG. 1 is more clearly illustrated in the enlarged views of FIGS. 4 and 5. This bracket is comprised of a fixed base 30 having a substantially flat wall engaging surface 31. A projection 32 extends from the base 30 in a horizontal plane. The base 30 may be affixed to a wall by any conventional means. Since the forces acting on the base 30 in use are mainly forces acting in the line of the axis of the rod 10 urging the base 30 against the wall, the mounting of this base may be simplified. For example, a single hole 33 may be provided in the base above the projection 32, for receiving a mounting screw 14 as illustrated in FIG. 1. In addition, a triangular vertically extending rib 34 may be provided on the mounting surface 31 below the projection 32, and vertically aligned with the hole 33. The rib 34 is adapted to dig into a wall upon which the base is mounted, to inhibit rotation of the base 30 about the axis of the mounting hole 33. This form of mounting simplifies the task of installing the bracket assembly of the invention, while providing the necessary support for the base.

The projection 32 is provided with a vertical aperture 35 of non-circular cross section. For example, as illustrated, the aperture 35 is octagonal, although it will be apparent that other regular polygonal shapes may be employed, as well as other shapes which would enable the placement and rotational locking of a pin of similar cross section therein at a number of different angular displacements. It is further to be noted that the aperture 35 is tapered, with the smaller cross section of this aperture being at the bottom of the projection 32. The axis or center of the aperture 35 is in the vertical plane perpendicular to the wall 13 which passes through the center of the hole 33 and in which the rib 34 lies.

The wall mounting bracket 12 further comprises a fitting 38 having a hole 39 formed in one end thereof for receiving the end of the rod or spindle 10. The end of the fitting 38 opposite the hole 39 is bifurcated, with an upper substantially horizontal fork 39*a* spaced from and above a lower substantially horizontal fork 40. A pin 41 extends vertically between the forks 39a and 40, this pin also extending through the aperture 35 of projection 32. The pin 41 has an octagonal cross section, as shown in FIGS. 4 and 5, this pin also tapering, with its smaller cross section at the bottom thereof. The upper end of the pin 41 has substantially the same size as the aperture 35, so that when the fitting 38 is in its lowermost position, as shown in solid lines in FIG. 4, with the upper fork 39 engaging the top of the projection 32, the projection 41 substantially fills the aperture 35 and inhibits relative rotation of the fitting 38 and base 30. As a result, when the fitting 38 is in the position illustrated in solid lines in FIG. 4, the rod or spindle 10 is held at a fixed angular position with respect to the wall.

The lower end of the pin 41 has a cross section that is sufficiently small so that, when the fitting 38 is raised to its uppermost position as shown in chain dot lines in FIG. 4, the pin can rotate in the aperture 35. As a consequence, it will be apparent that, by lifting the end of the rod or spindle 10 toward the wall, so that the lower fork 40 is against or close to the bottom of the projection 32, the rod may be relatively rotated about the axis of aperture 35, to enable repositioning the rod at an angle at which the upper ends of the pin 41 can be again slipped into the aperture 35. Thus, as illustrated in FIG. 2, when an octagonal pin and aperture are employed, the rod may be moved to afixed position perpendicular to the wall, as illustrated in solid lines, to positions in either direction to be parallel to the wall as illustrated in chain dot lines, or in either direction to be at an angle of 45° to the wall, as illustrated in chain dot lines. It is to be noted that the bracket may be thus moved out of the way, when not in use, to a position parallel to the wall.

Of course other shapes may be employed for the aperture 35 and the pin 41. Aside from further regular polygonal shapes, other shapes may be employed, which would enable positioning of the pin 41 at selected angular displacements in the aperture 35. The tapered polygonal shape is preferred, however, in view of the ease of forming such a shape, for example, by a die casting technique. In addition, while the tapering of the aperture and pin are preferred, in order to simplify the formation of the pin as well as to facilitate the relative alignment of the pin and aperture in adjusting the angular position of the rod. While the tapered shapes of the aperture and pin provide these features, it will be apparent that a non-tapered pin and aperture can alternately be employed, as long as the lower end of the pin has a cross section sufficiently small to enable its rotation in the aperture. In other words, the pin 41 may have a stepped configuration.

As was above discussed, when a load is supported by the hook 24, a downward moment results at the other end of the rod, which tends to hold the fitting 38 in its lowermost position at which relative rotation between the rod and the wall is inhibited. As a consequence, there is no danger of accidental repositioning of the rod. The angular adjustment may simply be effected by lifting the inner end of the rod or fitting 38 in the direction of the arrow 44 in FIG. 1, then rotating the rod, and releasing the upward force to permit the pin 41 to become locked at a new position in the aperture.

Figure 7:
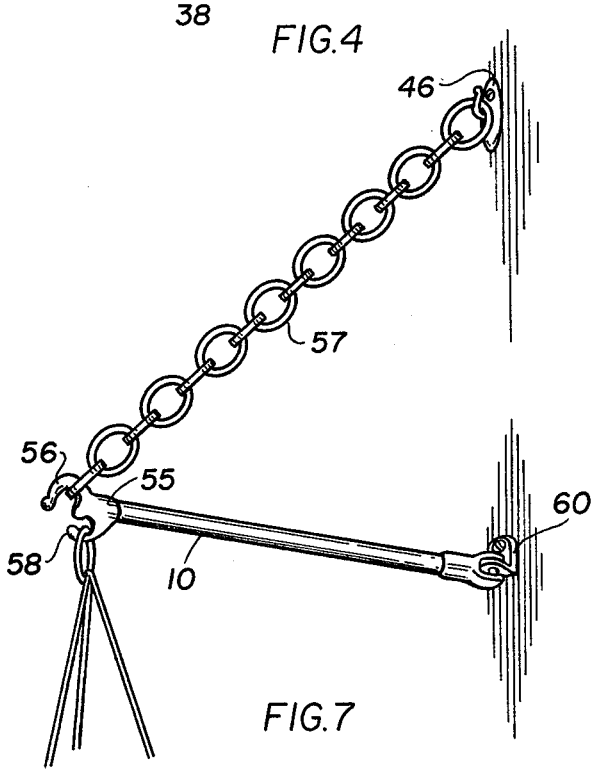
FIG. 7 is a view of a modification of the assembly of FIG. 1.

The chain 15 and strap 16 may be of conventional nature. Thus, the only requirement with respect to the chain 15 or cord, is that it be of adequate strength and adapted to be affixed to the end of the base 20. The strap 16 may be affixed to the wall 13 by the conventional means. It is to be noted that, alternatively, as shown in FIG. 7, the strap 16 may be replaced by a hook 46. Since the bracket will more usually be employed in a positon with the rod 10 extending normal to a wall, it is preferred that the axis of the hole 39 in the fitting 38 extend through the axis of the aperture 35 in the vertical plane extending through the axis of the aperture 35 and the axis of hole 33.

Figure 6:
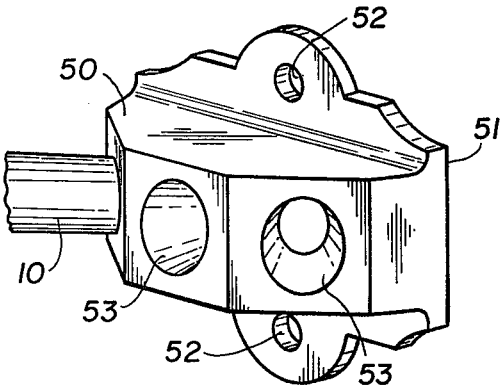
FIG. 6 is a perspective view of a modification of the bracket of the assembly of FIG. 1.

In the further embodiment of the wall mounting bracket as illustrated in FIG. 6, the bracket is comprised of a block-like member 50 having a wall mounting surface 51, and suitable holes 52 to enable mounting of the block 50 to a wall. A plurality of holes 53 are provided in the block 50 on the side thereof away from the mounting surface 51, the holes 53 extending at different angles in the same horizontal plane, and being shaped to receive the end of the rod 10. Thus, in this arrangement the rods may be removed from a hole 53, and placed in a different hole 53, in order to change the angular position of the rod. As illustrated in FIG. 6, three holes 53, at different angular dispositions, enable the placement of the rod at three separate angles with respect to the wall. It will be of course apparent that a greater or lesser number of such holes 53 may be provided.

In the further embodiment of the invention illustrated in FIG. 7, the hook member 55 at the outer end of the rod 10 is of a different configuration. In this arrangement, a simple upwardly extending hook 56 is provided at the remote end of the fitting 55 for receiving the chain 57, and a simple fixed hook 58 is provided extending downwardly from the fitting 55 for suspending an article. The hook 58 is of course disposed inwardly of the hook 56. The fitting 55 may thus be formed, for example by die casting, as a unitary member. The pivotal mounting of the arrangement of FIG. 7 is similar to that of the arrnagement of FIG. 1, with the base 60 thereof being in slightly modified form, without a lower extension. In a still further modification of the wall mounting bracket, as illustrated in FIGS. 8 and 9, a fixed base 70 adapted to be affixed to a wall in the same manner as the base 30 of FIG. 1, has a projection 71 extending therefrom in a horizontal plane. A fitting 72 has a bifurcated end fitted over the horizontal projection 71, and a pivot pin 73 extends through the projection 71 and into the upper and lower end portions 74, 75 of the fitting 72 for pivoting the fitting to the projection 71 for rotation in a horizontal plane. The projection 71 has a further vertical hole 76 spaced from the pivot pin, preferably in the direction therefrom away from the wall to which the wall mounting bracket is affixed. A series of vertically aligned holes 77 are provided in the ends 74, 75 about an arc spaced from the pivot pin the same distance as the hole 76. When a pair of aligned holes 77 is aligned with the hole 76, a removable pin 78 may be inserted through these holes from above, to fix the fitting 72 in a desired angular orientation.

The fitting 72 has a tapered aperture 79 for receiving the rod 10 in the same manner as the corresponding fitting 38 of the arrangement of FIG. 1. It is to be noted that the hole 79 has a depth greater than required to fully receive the tapered end of the rod 10. As a result, the end of the rod 10 will never contact the bottom of the hole 79, so that a good pressed fit between the rod 10 and the fitting 72 is obtainable at all times. Such arrangement may also be employed, for example, in the base member 20 and fitting 38 of the arrangement of FIG. 1.

In a preferred embodiment of the invention, the spindle or rod 10 is of wood or plastic, the base 20 and hook are of a die casting material formed for example as disclosed in in said copending application Ser. No. 549,313, and the wall mounting bracket 12 is of a die casting material formed in the same manner. In this die casting technique, one of the elements is first formed, for example by die casting, and the second element pivoted thereto is die cast employing the pivot joint portion of the first die cast member as a portion of its die. Since the rod or spindle 10 is only under compression, there is no need to provide a firm connection between the socket formed on the base 20 and fitting 38, it being adequate to merely slip the rod in these sockets. When the elements 11 and 12 were formed of a die casting material such as Zamak No. 3 zinc die casting alloy, and the rod 10 was of sufficient length to suspend an article 12 inches from a wall, the bracket assembly in accordance with the invention was suitable for suspending articles of a weight well in excess of 25 lbs. The resultant assembly is readily installed on a wall, and has a minimum of bulk and weight. Since a number of the elements may be formed of a die casting material, the resultant assembly can be formed with any desired ornamental features so that it is readily adaptable for use in a home enviornment. The adjustment of the bracket assembly to a different angular position is readily achieved with a minimum of effort. When a swivel hook is employed in combination with the bracket assembly, as illustrated in FIG. 1, the article suspended may be position as desired. This latter feature enables, for example, the rotation of a plant to enable desired placement thereof with respect to a source of light.

It will of course be apparent that the rod 10 may be formed of other materials than wood, such as, for example only, steel or aluminum. Alternatively, the rod 10 may be formed as an integral part of the hook fitting, such as the hook fitting 11 and/or the pivoted portion of the wall mounting bracket. The rod 10 may be formed by die casting, for example, as an integral part of one or both of the end fittings thereof.

While the invention has been disclosed and described with reference to a limited number of embodiments, it will be apparent that variations and modifications may be made therein, and it is intended in the following claims to cover each such variation and modification as falls within the true spirit and scope of the invention.

What is claimed is:

1. A bracket assembly comprising:

a rigid elongated support rod;

a fitting having a socket for receiving one end of said rod, hook means depending from said fitting for supporting an article;

a wall bracket having a socket for receiving the other end of said rod;

means for affixing said bracket to a wall;

an elongated end support means affixable to said fitting at a position further from said wall bracket than the distance between said hook means and said wall bracket;

said support means being adapted to be affixed to said wall and a point above said wall bracket to hold said support rod in a horizontal position, the portion of said wall bracket containing the socket thereof being movable between a plurality of angular detent positions with respect to said wall.

2. The bracket assembly of claim 1 wherein said bracket means comprises a first member having a mounting surface adapted to be mounted on a wall, and a second member pivotally mounted to said first member about a vertical axis and affixed to said support member.

3. The bracket assembly of claim 2 further comprising means for locking the pivot joint between said first and second members.

4. The bracket assembly of claim 3 wherein said second member is vertically movable with respect to said first member, said locking means comprising means responsive to the positioning of said second means in a lower position for inhibiting relative rotation of said first and second members and responsive to positioning of said second member in a second higher position for enabling relative rotation of said first and second members.

5. A bracket assembly, comprising:

a rigid elongated support member;

a support element depending from said support member near one end thereof for supporting an article;

a wall bracket;

means for affixing said bracket to a wall;

said bracket having a holding portion for supporting the other end of said support member, said other end being bifurcated with upper and lower fork members;

a pin extending vertically between said upper and lower fork members and affixed to at least one of said fork members, said holding portion of said wall bracket member having a horizontal projection with an aperture therein, said aperture extending vertically through said projection, said pin extending through said aperture between said upper and lower fork members; and an elongated end support means affixable to the support member at a position close to said one end thereof than said support element, said support means being adapted to be affixed to said wall at a point above said wall bracket to hold said support member in a horizontal position, said holding portion cooperating with said other end of said support member to define a plurality of angular detent positions of said support with respect to said wall, said support members being retainable in each of said detent positions by the downward movement resulting from the forces exerted on said support member by said end support means and the weight of said article as applied to said support member via said support element, said support member being rotatable, in a horizontal plane, between respective ones of said detent positions by applying an upward force thereto adjacent said holding portion of said wall bracket.

6. The bracket assembly of claim 5 wherein said pin has a non-circular cross section and tapers to have a smaller cross section at its lower end, and said aperture has a non-circular cross section and tapers to have a smaller cross section at its lower end.

7. The bracket assembly of claim 6 wherein said pin and aperture have cross sections in the form of regular polygons of the same number of sides, the upper end of said pin having a size substantially equal to that of said aperture, the lower end of said pin having a cross section sufficiently smaller than that of said aperture to permit relative rotation of said first and second members when said lower end of said pin is aligned in said aperture.

8. The bracket assembly of claim 7 wherein said first member has a mounting surface adapted to engage a wall, a hole extending through said mounting surface, and a ridge on said mounting surface.

9. The bracket assembly of claim 5 wherein said other end of said support member is integrally formed with said wall bracket.

10. A bracket assembly, comprising:

a rigid elongated support member;

a support element depending from said support member near one end thereof for supporting an article;

a wall bracket;

means for affixing said bracket to a wall;

said bracket having a holding portion for supporting the other end of said support member, said other end being tapered, said wall bracket holding portion having at least one tapered aperture for receiving said tapered end of said support member, said tapered aperture having a length greater than the length of the portion of said tapered end that can be received therein; and an elongated end support means affixable to the support member at a position close to said one end thereof than said support element, said support means being adapted to be affixed to said wall at a point above said wall bracket to hold said support member in a horizontal position, said holding portion cooperating with said other end of said support member to define a plurality of angular detent positions of said support with respect to said wall, said support members being retainable in each of said detent positions by the downward movement resulting from the forces exerted on said support member by said end support means and the weight of said article as applied to said support member via said support element, said support member being rotatable, in a horizontal plane, between respective ones of said detent positions by applying an upward force thereto adjacent said holding portion said wall bracket.

11. A bracket assembly, comprising:

a rigid elongated support member;

a support element comprising a unitary hook member secured to said support member at one end thereof, said hook member having a downwardly extending hook for supporting an article;

a wall bracket;

means for affixing said bracket to a wall;

said bracket having a holding portion for supporting the other end of said support member, said hook member having an upwardly extending hook at a position further from said other end of said support member than said downwardly extending hook, a flexible elongated end support means affixable at one end thereof to said upwardly extending hook, the other end of said support means being adapted to be affixed to said wall at a point above said wall bracket to hold said support member in a horizontal position, said holding portion cooperating with said other end of said support member to define a plurality of angular detent positions of said support with respect to said wall, said support member being retainable in each of said detent positions by the downward movement resulting from the forces exerted on said support member by said end support means and the weight of said article as applied to said support member via said support element, said support member being rotatable, in a horizontal plane, between respective ones of said detent positions by applying an upward force thereto adjacent said holding portion of said wall bracket.

* * * * *